US009187872B1

(12) United States Patent
Hermanson

(10) Patent No.: US 9,187,872 B1
(45) Date of Patent: Nov. 17, 2015

(54) SHUVALOT

(71) Applicant: Jeff Hermanson, Sioux Falls, SD (US)

(72) Inventor: Jeff Hermanson, Sioux Falls, SD (US)

( * ) Notice: Subject to any disclaimer, the term of this patent is extended or adjusted under 35 U.S.C. 154(b) by 89 days.

(21) Appl. No.: 13/832,888

(22) Filed: Mar. 15, 2013

(51) Int. Cl.
*E01H 5/02* (2006.01)
*E01H 5/06* (2006.01)

(52) U.S. Cl.
CPC ... *E01H 5/02* (2013.01); *E01H 5/06* (2013.01)

(58) Field of Classification Search
CPC ..... E01H 5/02; E01H 5/06; E01H 5/065; E01H 5/066
USPC ..... 37/270, 264–266, 272–274, 278, 279, 37/284, 285
See application file for complete search history.

(56) References Cited

U.S. PATENT DOCUMENTS

| | | | | | |
|---|---|---|---|---|---|
| 187,222 | A * | 2/1877 | Dowler | 172/346 |
| 830,871 | A | 9/1906 | Wilken | |
| 1,375,505 | A * | 4/1921 | Grady | 37/284 |
| 1,956,295 | A * | 4/1934 | Lindgren | 37/284 |
| 2,388,985 | A * | 11/1945 | Martin | 37/283 |
| 2,811,792 | A | 11/1957 | Cork, Jr. | |
| 3,337,973 | A * | 8/1967 | Prescott | 37/265 |
| 3,938,843 | A * | 2/1976 | Pahl | 37/266 |
| 3,994,081 | A * | 11/1976 | Middleton | 37/273 |
| 4,910,893 | A | 3/1990 | Asay | |
| 5,048,883 | A * | 9/1991 | Waluk | 294/54.5 |
| 5,440,828 | A | 8/1995 | Simpson | |
| 6,334,640 | B1 * | 1/2002 | Werner et al. | 294/54.5 |
| 6,675,507 | B2 * | 1/2004 | Petruzzelli | 37/284 |
| 6,948,268 | B1 | 9/2005 | Ronca | |
| 8,001,707 | B2 | 8/2011 | Coles | |
| 8,070,198 | B2 | 12/2011 | Burke | |
| 8,166,677 | B1 * | 5/2012 | Woyak | 37/265 |
| 2007/0013198 | A1 | 1/2007 | Brazeau | |

FOREIGN PATENT DOCUMENTS

| | | | | |
|---|---|---|---|---|
| FR | 2692296 A3 | | 12/1993 | |
| FR | 2692296 A3 * | | 12/1993 | E01H 5/02 |
| WO | WO 97/49869 | | 12/1997 | |

* cited by examiner

*Primary Examiner* — Thomas B Will
*Assistant Examiner* — Joan D Misa

(57) ABSTRACT

A push shovel assembly facilitates pushing snow in a desired direction by permitting limited pivoting of a shovel blade in a selectable direction left or right during use. The assembly includes a blade and a pair of arms. Each arm has a lower end pivotally coupled to the blade. Each of a pair of wheels is rotatably coupled to an associated one of the arms. A brace is pivotally coupled to and extends between the arms. Each of a pair of stop pins is coupled to the brace proximate an associated one of the arms wherein pivoting of the brace relative to the arms is restricted by each stop pin when each stop pin abuts the associated arm.

20 Claims, 5 Drawing Sheets

SHUVALOT

BACKGROUND OF THE DISCLOSURE

Field of the Disclosure

The disclosure relates to shovel devices and more particularly pertains to a new shovel device for facilitating pushing snow in a desired direction by permitting limited pivoting of a shovel blade in a selectable direction left or right during use.

SUMMARY OF THE DISCLOSURE

An embodiment of the disclosure meets the needs presented above by generally comprising a blade and a pair of arms. Each arm has a lower end pivotally coupled to the blade. Each of a pair of wheels is rotatably coupled to an associated one of the arms. A brace is pivotally coupled to and extends between the arms. Each of a pair of stop pins is coupled to the brace proximate an associated one of the arms wherein pivoting of the brace relative to the arms is restricted by each stop pin when each stop pin abuts the associated arm.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
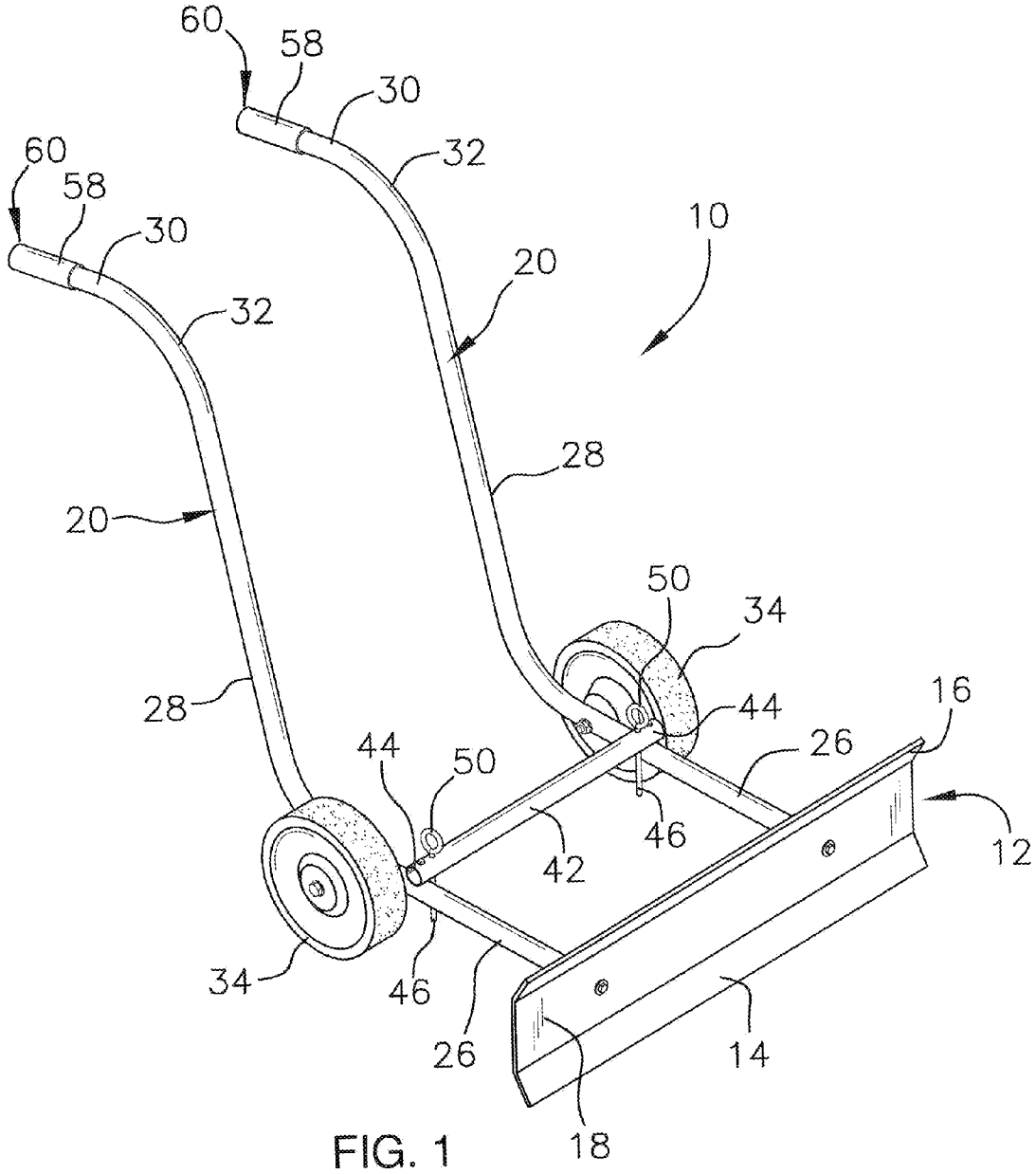
FIG. 1 is a top front side perspective view of a push shovel assembly according to an embodiment of the disclosure.
Figure 2:
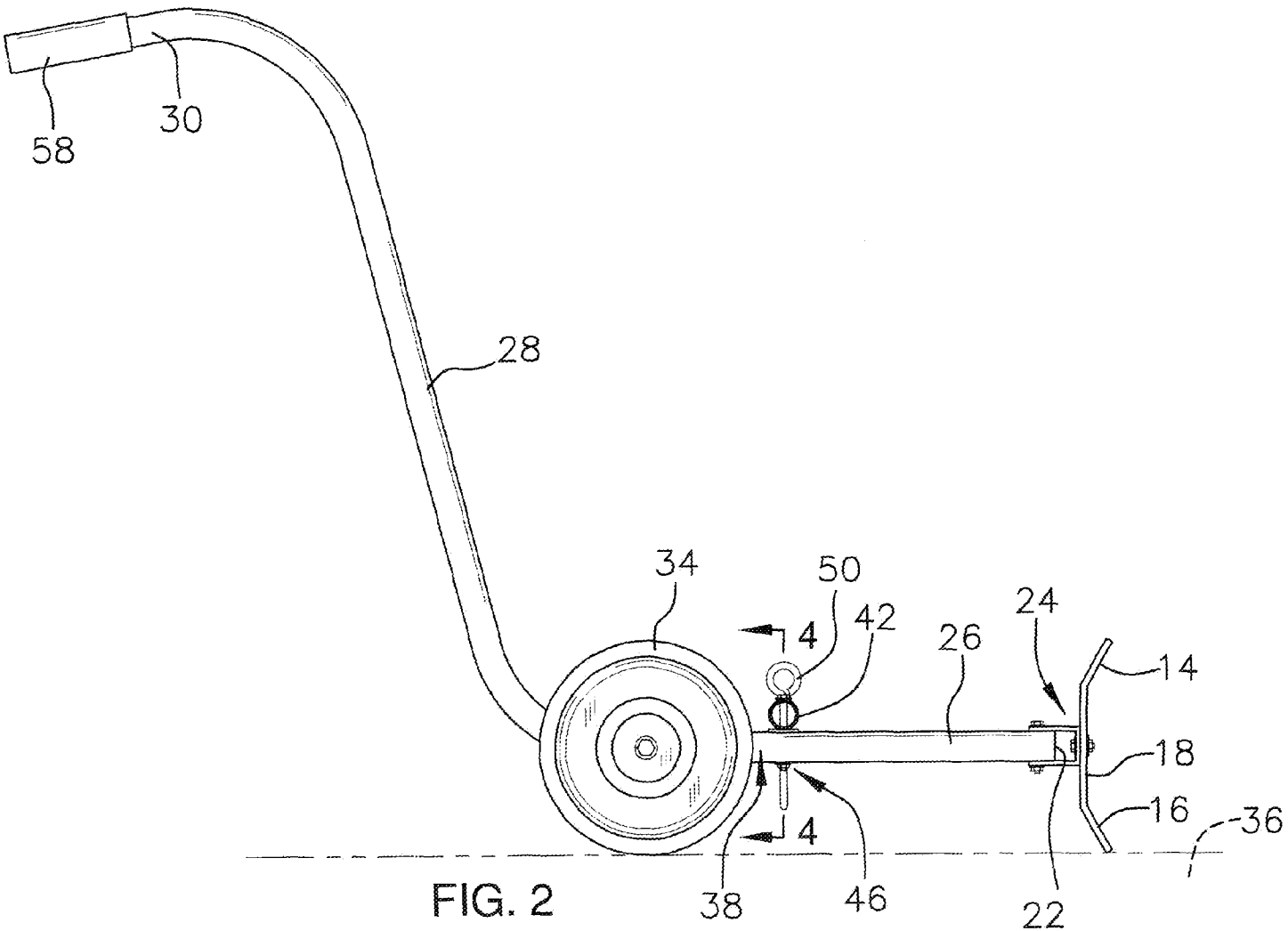
FIG. 2 is a side view of an embodiment of the disclosure.
Figure 4:
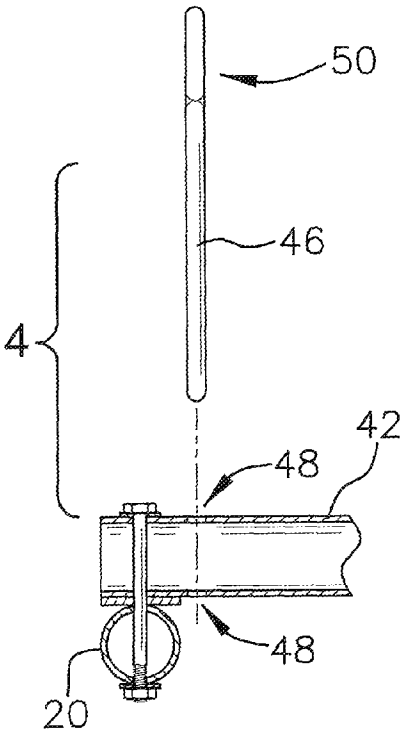
FIG. 4 is a cross-sectional view of an embodiment of the disclosure taken along line 4-4 of FIG. 2.
Figure 3:
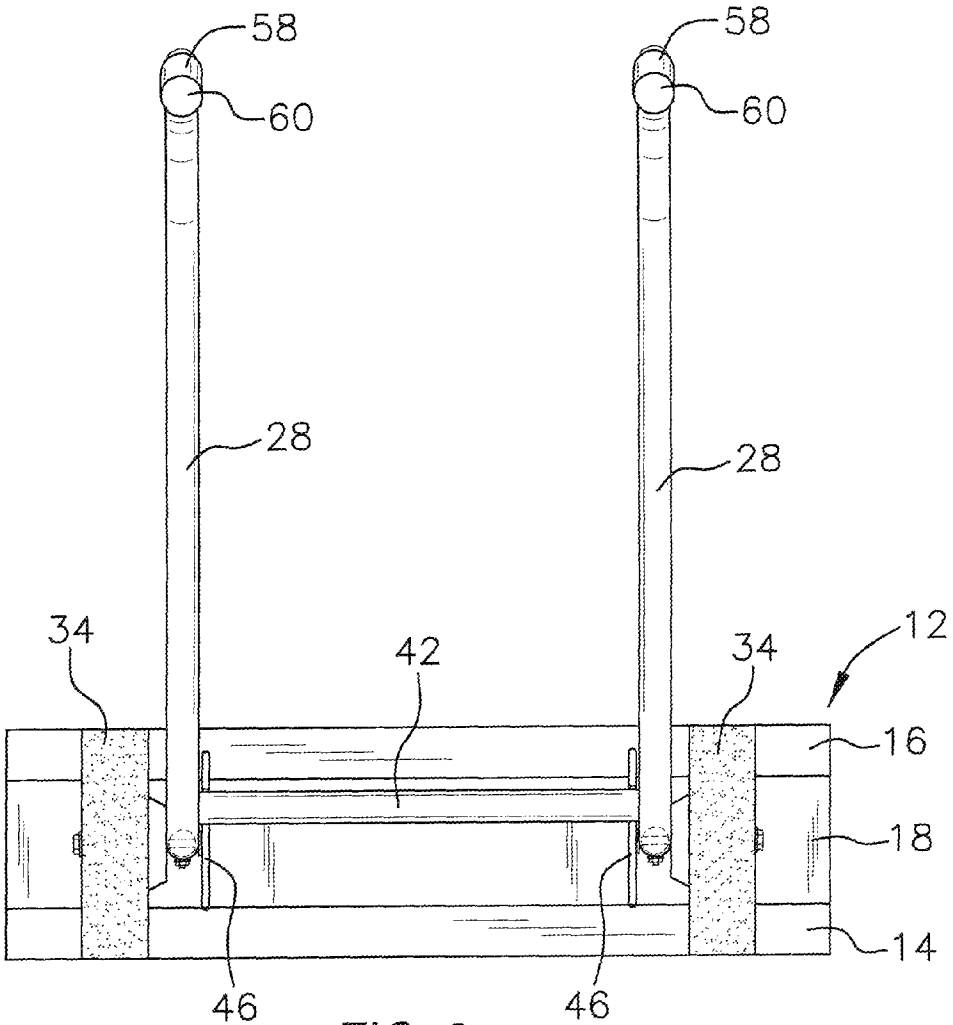
FIG. 3 is a back view of an embodiment of the disclosure.
Figure 5:
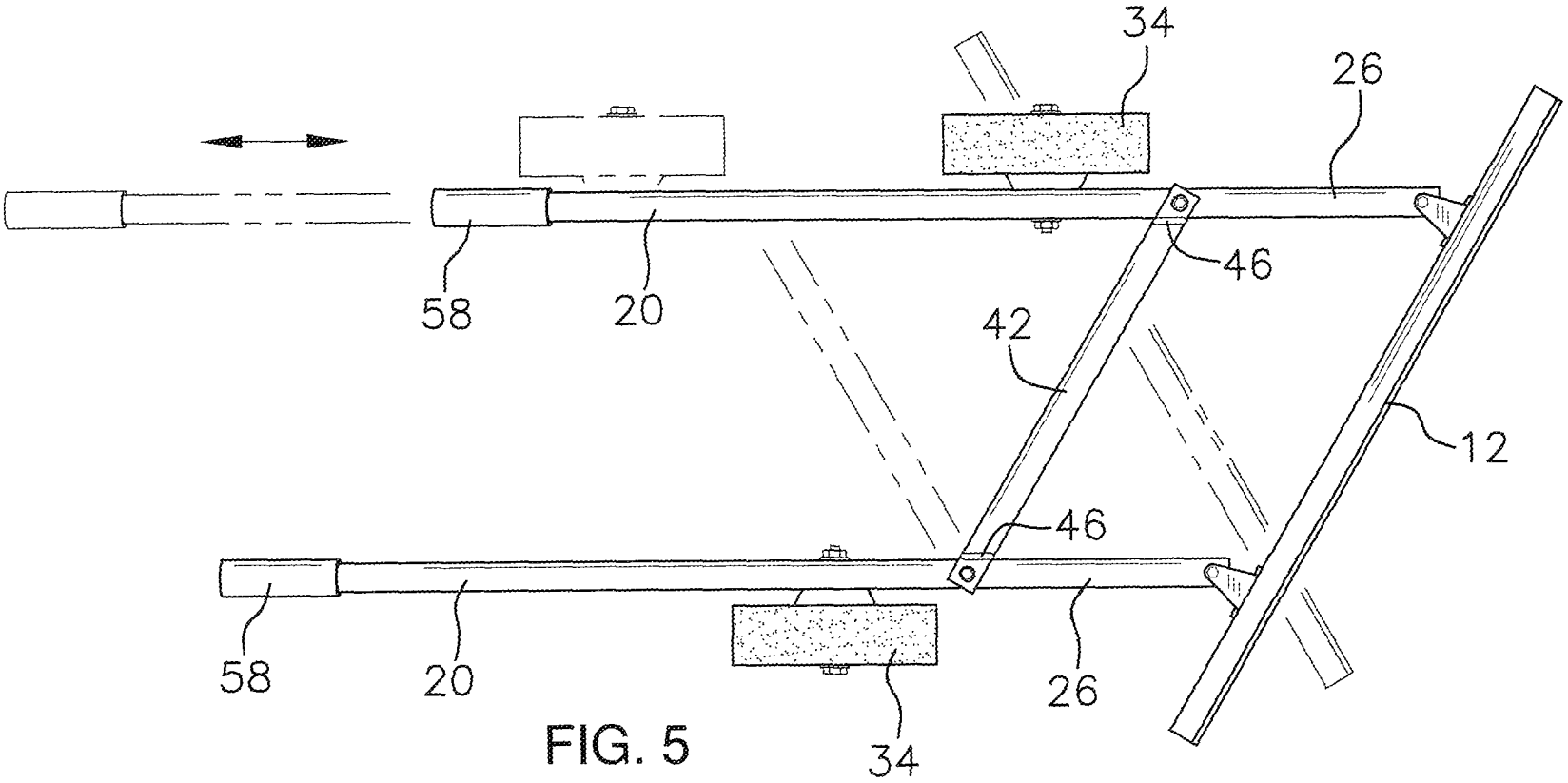
FIG. 5 is a top view of an embodiment of the disclosure in a use position.

With reference now to the drawings, and in particular to FIGS. 1 through 6 thereof, a new shovel device embodying the principles and concepts of an embodiment of the disclosure and generally designated by the reference numeral 10 will be described.

As best illustrated in FIGS. 1 through 6, the push shovel assembly 10 generally comprises a blade 12 having a forwardly angled lower section 14, a forwardly angled upper section 16 and a straight medial section 18 extending between the lower section 14 and the upper section 16. A lower end 22 of each of a pair of arms 20 is pivotally coupled to the blade 12 on a back side 24 of the medial section 18. Each arm 20 has a substantially straight base section 26 extending from the blade 12. A medial section 28 extends upwardly from the base section 26 and a handle section 30 extends from a top end 32 of the medial section 28. The base section 26 may extend from the blade 12 at a right angle as shown or may be angled relative to the back side 24 between 70 and 110 degrees. Each of a pair of grips 58 may be coupled to an associated one of the arms 20 on a terminal end 60 of the handle section 30 for facilitating gripping of the arms 20.

Each of a pair of wheels 34 is rotatably coupled to an associated one of the arms 20 to support the arms 20 on a supporting surface 36. Each wheel 34 is coupled to the base section 26 of the associated arm 20 proximate the medial section 28 of the associated arm 20 providing a sufficiently broad base between the wheels 34 and the blade 12 to permit the assembly 10 to stand freely on the support surface 36. Each wheel 34 is coupled to and extends from an outer side 38 of the associated arm 20 to facilitate folding of the assembly 10 into a storage position 40 as described in more detail below.

A brace 42 has opposite ends 44 pivotally coupled to the arms 20. The brace 42 extends between the arms 20. The brace 42 is coupled to the arms 20 between the wheels 34 and the blade 12. The brace 42 is positioned in spaced relationship to the blade 12 and is coupled to the arms such that the arms remain parallel and the brace 42 is parallel to the blade 12. The brace 42 may be positioned proximate the wheels 34.

Figure 6:
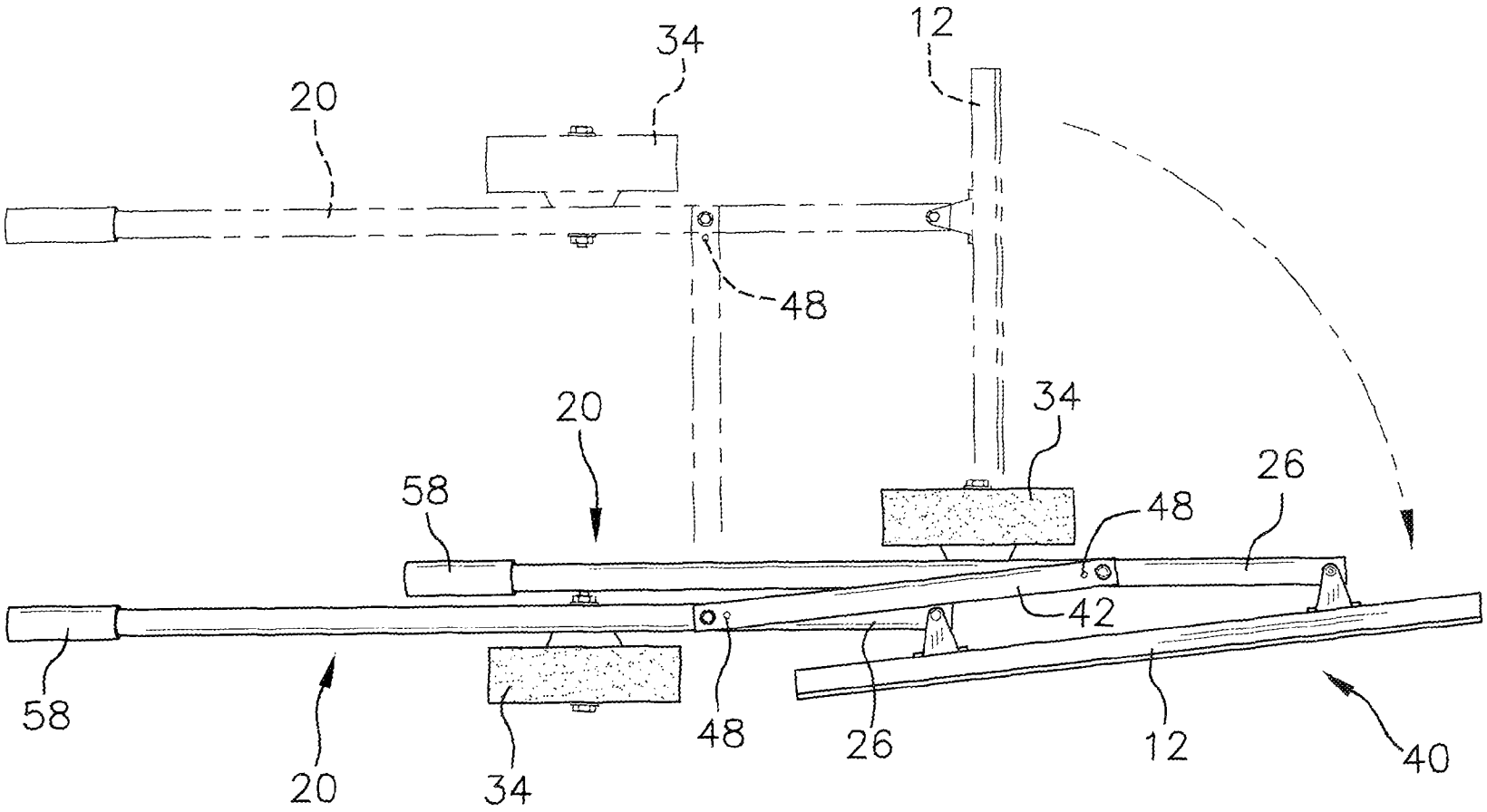
FIG. 6 is a top view of an embodiment of the disclosure in a storage position.

Each of a pair of stop pins 46 is coupled to the brace 42 proximate an associated one of the arms 20 wherein pivoting of the brace 42 relative to the arms 20 is restricted by each stop pin 46 when each stop pin 46 abuts the associated arm 20. Each stop pin 46 may extend through vertically aligned apertures 48 extending through the brace 42. Each stop pin may include an upper loop 50 to facilitate manipulation of the stop pin 46. Each stop pin 46 is coupled to the brace 42 between the arms 20. Each stop pin 46 is selectively removable from the brace 42 permitting less restricted pivoting of the arms 20 into the storage position 40, as shown in FIG. 6, wherein the arms 20 are positioned offset and substantially adjacent to each other. The stop pins 46 may be equidistant from the associated arm 20 such that they contact the associated arm 20 substantially simultaneously.

In use, the stop pins 46 are inserted through the brace 42 and the arms 20 grasped by the grips 58. The arms 20 are pushed to move the blade 12 forward as the wheels 34 turn on the support surface 36. The arms 20 are manipulated forward and backward relative to each other to achieve a desired angle of the blade 12 to the left or right as the blade 12 is pushed forward to move snow from the support surface 36 in a desired direction. When finished, the stop pins 46 may be removed from the brace 42 and the arms 20 moved relative to each other to collapse the assembly 12 into the storage position 40.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility' that more than one of the element is present, unless the context clearly requires that there be only one of the elements.

I claim:

1. A push shovel assembly comprising:

a blade;

a pair of arms, each arm having a lower end pivotally coupled to said blade, each arm having a base section being attached to and extending from said blade, a medial section extending upwardly from said base section, and a handle section extending from a top end of said medial section;

a pair of wheels, each wheel being rotatably coupled to an associated one of said arms, said wheels being positioned such that said base sections are positioned between said blade and said wheels, each of said wheels having an axis of rotation extending through said base sections of said arms;

a brace pivotally coupled to and extending between said arms, said arms being oriented parallel to each other, said arms remaining parallel to each other as said arms are pivoted relative to said brace; and a pair of stop pins, each stop pin being coupled to said brace proximate an associated one of said arms wherein pivoting of said brace relative to said arms is restricted by each stop pin when each said stop pin abuts said associated arm.

2. The assembly of claim 1, further comprising each said stop pin being selectively removable from said brace permitting pivoting of said arms into a storage position wherein said arms are positioned offset and substantially adjacent to each other defining a storage position.

3. The assembly of claim 1, further comprising each said wheel being coupled to and extending from an outer side of said associated arm.

4. The assembly of claim 1, further comprising each said wheel being coupled to said base section of said associated arm proximate said medial section of said associated arm.

5. The assembly of claim 4, further comprising said brace being coupled to said arms between said wheels and said blade.

6. The assembly of claim 1, further comprising each said stop pin being coupled to said brace between said arms.

7. The assembly of claim 1, further comprising said blade having a forwardly angled lower section, a forwardly angled upper section and a straight medial section extending between said lower section and said upper section.

8. The assembly of claim 1, further comprising a pair of grips, each grip being coupled to an associated one of said arms for facilitating gripping of said arms.

9. The push shovel assembly according to claim 1, wherein said wheels are positioned at a juncture of associated ones of said medial and base sections.

10. The push shovel assembly according to claim 1, wherein said medial sections of said arms extend upwardly from said base sections when said base sections are horizontally oriented, said handle sections of said arms extending rearward and downward from said medial sections when said base sections are horizontally oriented.

11. A push shovel assembly comprising:

a blade, said blade having a forwardly angled lower section, a forwardly angled upper section and a straight medial section extending between said lower section and said upper section;

a pair of arms, each arm having a lower end pivotally coupled to said blade, each arm having a substantially straight base section extending from said blade, a medial section extending upwardly from said base section, and a handle section extending from a top end of said medial section;

a pair of wheels, each wheel being rotatably coupled to an associated one of said arms, each said wheel being coupled to said base section of said associated arm proximate said medial section of said associated arm, each said wheel being coupled to and extending from an outer side of said associated arm, said wheels being positioned such that said base sections are positioned between said blade and said wheels, each of said wheels having an axis of rotation extending through said base sections of said arms;

a brace pivotally coupled to and extending between said arms, said brace being coupled to said arms between said wheels and said blade;

a pair of stop pins, each stop pin being coupled to said brace proximate an associated one of said arms wherein pivoting of said brace relative to said arms is restricted by each stop pin when each said stop pin abuts said associated arm, each said stop pin being coupled to said brace between said arms, each said stop pin being selectively removable from said brace permitting pivoting of said arms into a storage position wherein said arms are positioned offset and substantially adjacent to each other defining a storage position; and a pair of grips, each grip being coupled to an associated one of said arms for facilitating gripping of said arm.

12. The push shovel assembly according to claim 11, wherein said wheels are positioned at a juncture of associated ones of said medial and base sections.

13. The push shovel assembly according to claim 11, wherein said medial sections of said arms extend upwardly from said base sections when said base sections are horizontally oriented, said handle sections of said arms extending rearward and downward from said medial sections when said base sections are horizontally oriented.

14. A push shovel assembly comprising:

a blade;

a pair of arms, each arm having a lower end pivotally coupled to said blade, each arm having a base section being attached to and extending from said blade, a medial section extending upwardly from said base section, and a handle section extending from a top end of said medial section, said medial sections of said arms extending upwardly from said base sections when said base sections are horizontally oriented, said handle sections of said arms extending rearward and downward from said medial sections when said base sections are horizontally oriented;

a pair of wheels, each wheel being rotatably coupled to an associated one of said arms, said wheels being positioned such that said base sections are positioned between said blade and said wheels, each of said wheels having an axis of rotation extending through said base sections of said arms;

a brace pivotally coupled to and extending between said arms, said arms being oriented parallel to each other, said arms remaining parallel to each other as said arms are pivoted relative to said brace; and a pair of stop pins, each stop pin being coupled to said brace proximate an associated one of said arms wherein pivoting of said brace relative to said arms is restricted by each stop pin when each said stop pin abuts said associated arm.

15. The assembly of claim 14, further comprising each said stop pin being selectively removable from said brace permitting pivoting of said arms into a storage position wherein said arms are positioned offset and substantially adjacent to each other defining a storage position.

16. The assembly of claim 14, further comprising each said wheel being coupled to and extending from an outer side of said associated arm.

17. The assembly of claim 14, further comprising each said wheel being coupled to said base section of said associated arm proximate said medial section of said associated arm.

18. The assembly of claim 14, further comprising said brace being coupled to said arms between said wheels and said blade.

19. The assembly of claim 14, further comprising each said stop pin being coupled to said brace between said arms.

20. The assembly of claim 14, further comprising a pair of grips, each grip being coupled to an associated one of said arms for facilitating gripping of said arms.

* * * * *